US007946666B2

(12) United States Patent
Huang et al.

(10) Patent No.: US 7,946,666 B2
(45) Date of Patent: May 24, 2011

(54) SLIDE RAIL

(75) Inventors: Kuo-Ming Huang, Taipei Hsien (TW); Mo-Ming Yu, Shenzhen (CN); Zong-Yuan Li, Shenzhen (CN); Shi-An Chen, Shenxhen (CN); Song Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 729 days.

(21) Appl. No.: 11/953,862

(22) Filed: Dec. 11, 2007

(65) Prior Publication Data

US 2008/0191593 A1 Aug. 14, 2008

(30) Foreign Application Priority Data

Feb. 12, 2007 (CN) ..... 2007 1 0200199

(51) Int. Cl.
*A47B 95/00* (2006.01)
*A47B 88/16* (2006.01)

(52) U.S. Cl. ..... 312/333; 312/334.46

(58) Field of Classification Search ..... 312/334.1, 312/334.7, 334.8, 334.11, 333, 334.44–334.47
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 6,254,210 | B1 * | 7/2001 | Parvin | 312/334.46 |
| 6,824,233 | B2 * | 11/2004 | Chen et al. | 312/334.46 |
| 6,851,773 | B2 * | 2/2005 | Chen et al. | 312/334.46 |
| 2004/0207301 | A1 | 10/2004 | Chen et al. | |
| 2004/0239221 | A1 * | 12/2004 | Yang | 312/334.46 |
| 2006/0033409 | A1 * | 2/2006 | Chen et al. | 312/333 |
| 2006/0163983 | A1 * | 7/2006 | Wu | 312/333 |
| 2006/0244349 | A1 * | 11/2006 | Chen et al. | 312/334.47 |
| 2008/0122333 | A1 * | 5/2008 | Tseng et al. | 312/333 |
| 2008/0150409 | A1 * | 6/2008 | Huang et al. | 312/334.46 |

* cited by examiner

*Primary Examiner* — Darnell M Jayne
*Assistant Examiner* — Timothy M Ayres
(74) *Attorney, Agent, or Firm* — Frank R. Niranjan

(57) ABSTRACT

A slide rail includes an inner slide, an intermediate slide, a rack and a positioning element. The intermediate slide is used for receiving the inner slide; a block is positioned at an end of the intermediate slide. The rack has a plurality of ball bearings. An end of the rack is resisted against the block. The positioning element includes a fixing portion mounted to the intermediate slide, and a resilient hook portion having an ear part, the ear part capable of resisting against the other end of the rack to locate the rack.

18 Claims, 5 Drawing Sheets

SLIDE RAIL

BACKGROUND

1. Field of the Invention

The present invention generally relates to slide rails. Particularly, the present invention relates to a slide rail with a rack for ball bearings.

2. Description of Related Art

Slide rails are used for guiding objects, such as drawers, to be pulled into or out from bodies, such as furniture. There are several kinds of slide rails, some have ball bearings but others have not. Slide rails without ball bearings have lower costs than those having ball bearings and generally have two slides movable relative to each other. The two slides contact each other without ball bearings, which makes pushing and pulling of the slides difficult because friction between the slides.

Slide rails having ball bearings are easy to be pulled or pushed, however, the slides are difficult to be installed if the racks are not fixed, which may cause the slides and the racks to be damaged.

SUMMARY

In one embodiment, a slide rail includes an inner slide, an intermediate slide, a rack and a positioning element. The intermediate slide is used for receiving the inner slide, a block is positioned at an end of the intermediate slide. The rack has a plurality of ball bearings and is disposed between the inner slide and the intermediate slide. The rack is used for providing smooth movement between the inner slide and the intermediate slide. An end of the rack is resisted against the block. The positioning element includes a fixing portion mounted to the intermediate slide, and a resilient hook portion having an ear part, the ear part capable of resisting against the other end of the rack to locate the rack.

Other advantages and novel features of the slide rail will become more apparent from the following detailed description of embodiments when taken in conjunction with the accompanying drawings, in which:

DETAILED DESCRIPTION

Figure 1:
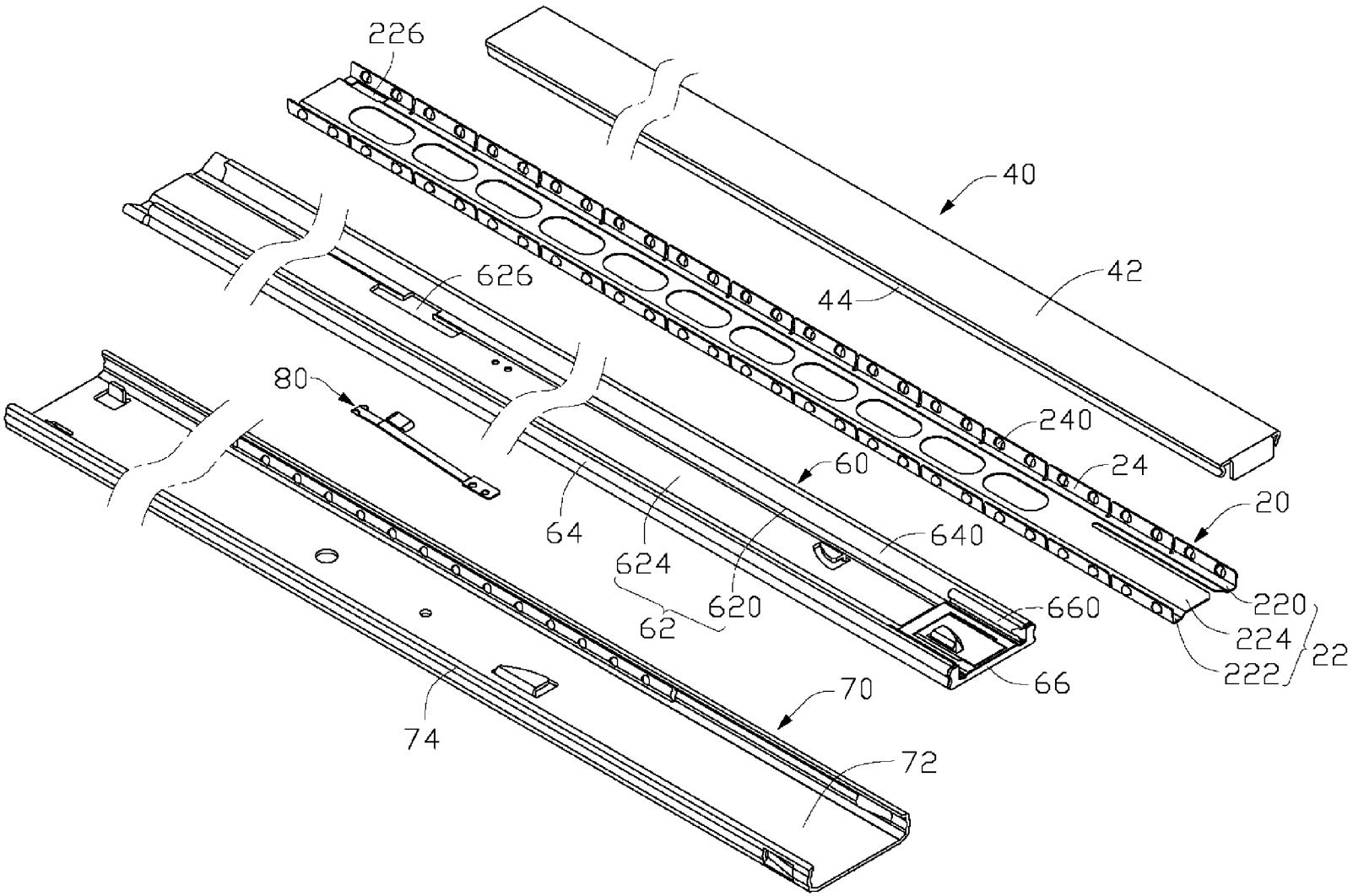
FIG. 1 is an exploded, isometric view of a slide rail in accordance with an exemplary embodiment of the present invention, the slide rail including a positioning element and an intermediate slide.

Referring to FIG. 1, a slide rail in accordance with an embodiment of the present invention includes a rack 20, an inner slide 40, an intermediate slide 60, an outer slide 70, and a positioning element 80.

The rack 20 is installed between the inner slide 40 and the intermediate slide 60, for assisting relative motion between the inner slide 40 and the intermediate slide 60. The inner slide 40, together with the rack 20, is generally received in the intermediate slide 60, and the intermediate slide 60 is generally received in the outer slide 70.

The rack 20 includes a main part 22 and two flanges 24 perpendicularly extending in a same direction from opposite sides of the main part 22 respectively. The main part 22 includes two first guiding grooves 220, 222 stamped therefrom and respectively connected to the two flanges 24, and a first flat part 224 connected between the first guiding grooves 220, 222. The first guiding grooves 220, 222 are symmetrically connected to opposite edges of the first flat part 224. The first flat part 224 is slightly raised from the first guiding grooves 220, 222. A hole 226 is defined in one end of the first guiding groove 220. A plurality of ball bearings 240 is rotatably mounted in each flange 24.

The inner slide 40 includes an inner portion 42 and two sidewalls 44 generally perpendicularly extending from opposite sides of the inner portion 42 respectively. Each of the sidewalls 44 is slightly concave to form a first slideway at an outer surface thereof.

The intermediate slide 60 includes an intermediate portion 62, two sidewalls 64 extending from opposite sides of the intermediate portion 62, and a block 66. The intermediate portion 62 includes two second guiding grooves 620 stamped therefrom and connected to the corresponding sidewalls 64, and a second flat part 624 connected between the second guiding grooves 620. The second flat part 624 is slightly raised from the second guiding grooves 620 that are symmetrically connected to opposite edges of the second flat part 624. Each sidewall 64 is concave to form a second slideway 640 at an inner surface thereof. The block 66 includes a base mounted to an end of the intermediate portion 62, and two arms 660 extending from opposite sides of the base. The arms 660 are attached to inner surfaces of the corresponding sidewalls 64. A slot 626 is defined in the intermediate portion 62 at a junction of the second flat part 624 and one of the second guiding grooves 620, a distance between the slot 626 and the block 60 is generally equal to a length of the rack 20.

The outer slide 70 includes an outer portion 72, and two sidewalls 74 extending from opposite sides of the outer portion 72 respectively. The intermediate slide 60 is received in a space bounded by the outer portion 72 and the sidewalls 74.

Figure 2:
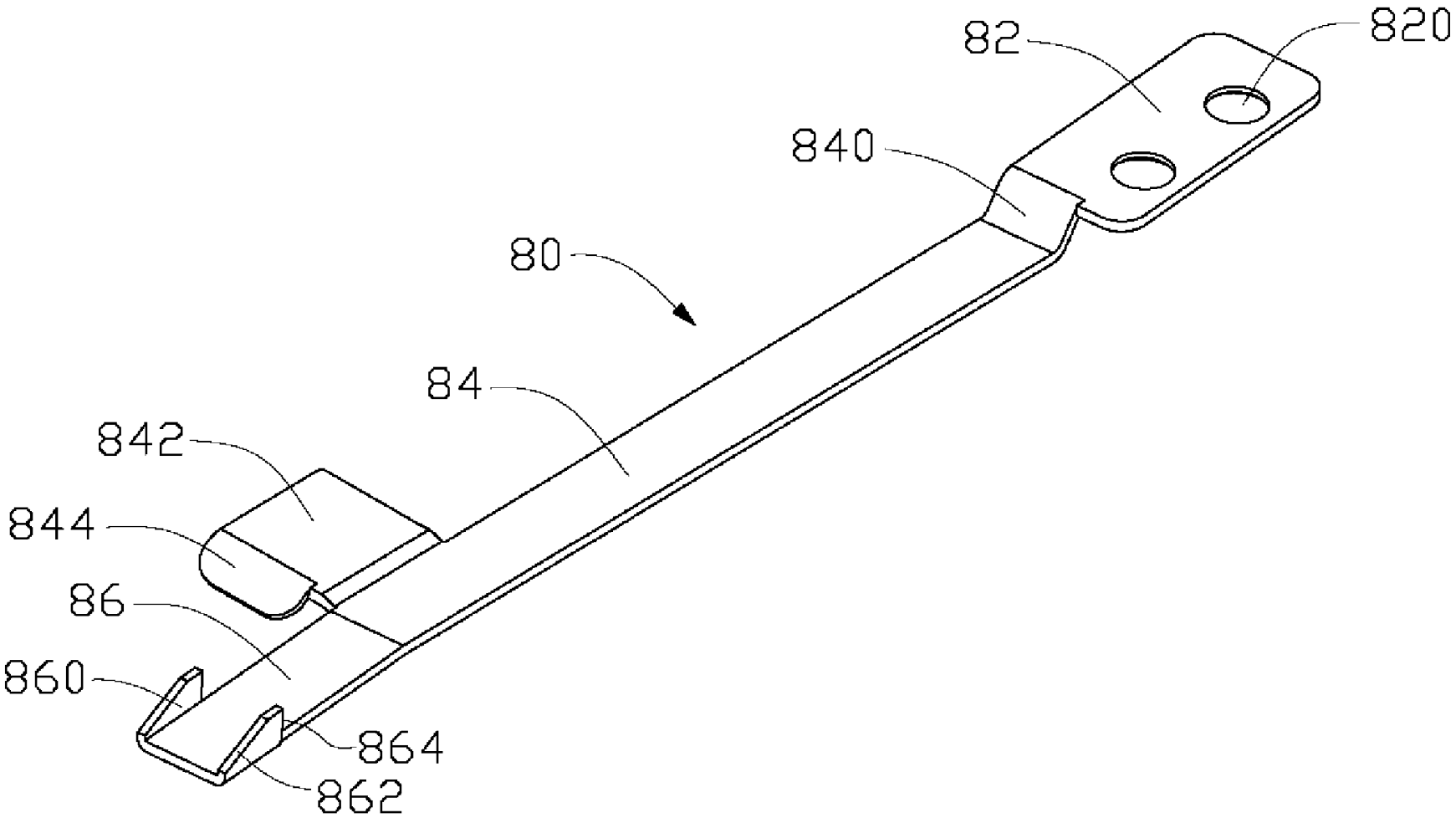
FIG. 2 is an amplified, isometric view of the positioning element of FIG. 1, but viewed from another aspect.

Referring also to FIG. 2, the positioning element 80 is used for positioning the rack 20 in the intermediate slide 60, and facilitating the relative motion of the rack 20 to the intermediate slide 60. The positioning element 80 includes a fixing portion 82, a bridge portion 84, and a hook portion 86. The fixing portion 82 is set at a first end of the bridge portion 84, with two fixing holes 820 defined therein, for fixing the positioning element 80 to the intermediate slide 60. The hook portion 86 is set at a second end of the bridge portion 84, opposite to the fixing portion 82. The bridge portion 84 is made of elastic material, thus the bridge portion 84 together with the hook portion 86 can be bent relative to the fixing portion 82. The bridge portion 84 is connected to the fixing portion 82 via a slanting connection portion 840. An angle between the fixing portion 82 and the connection portion 840 is unequal to that between the connection portion 840 and the bridge portion 84, thus, the bridge portion 84 is not parallel to the fixing portion 82. A vertical distance between the fixing portion 82 and the first end of the bridge portion 84 is slightly greater than that between the fixing portion 82 and the second end of the bridge portion 84. The hook portion 86 is slanting to the bridge portion 84 but parallel to the fixing portion 82. Two ears 860 perpendicularly extend in a same direction from opposite sides of a distal end of the hook portion 86 respectively. Each ear 860 has a sloped surface 862 facing the distal end of the hook portion 86, and an upright surface 864 opposite to the sloped surface 862. A plate 842 extends from a side of the bridge portion 84 at the second end. The plate 842 is slightly raised from the bridge portion 84, and has two guiding parts 844 slantingly extending from opposite ends thereof respectively. A distal end of each guiding part 844 is lower than the plate 842.

Figure 3:
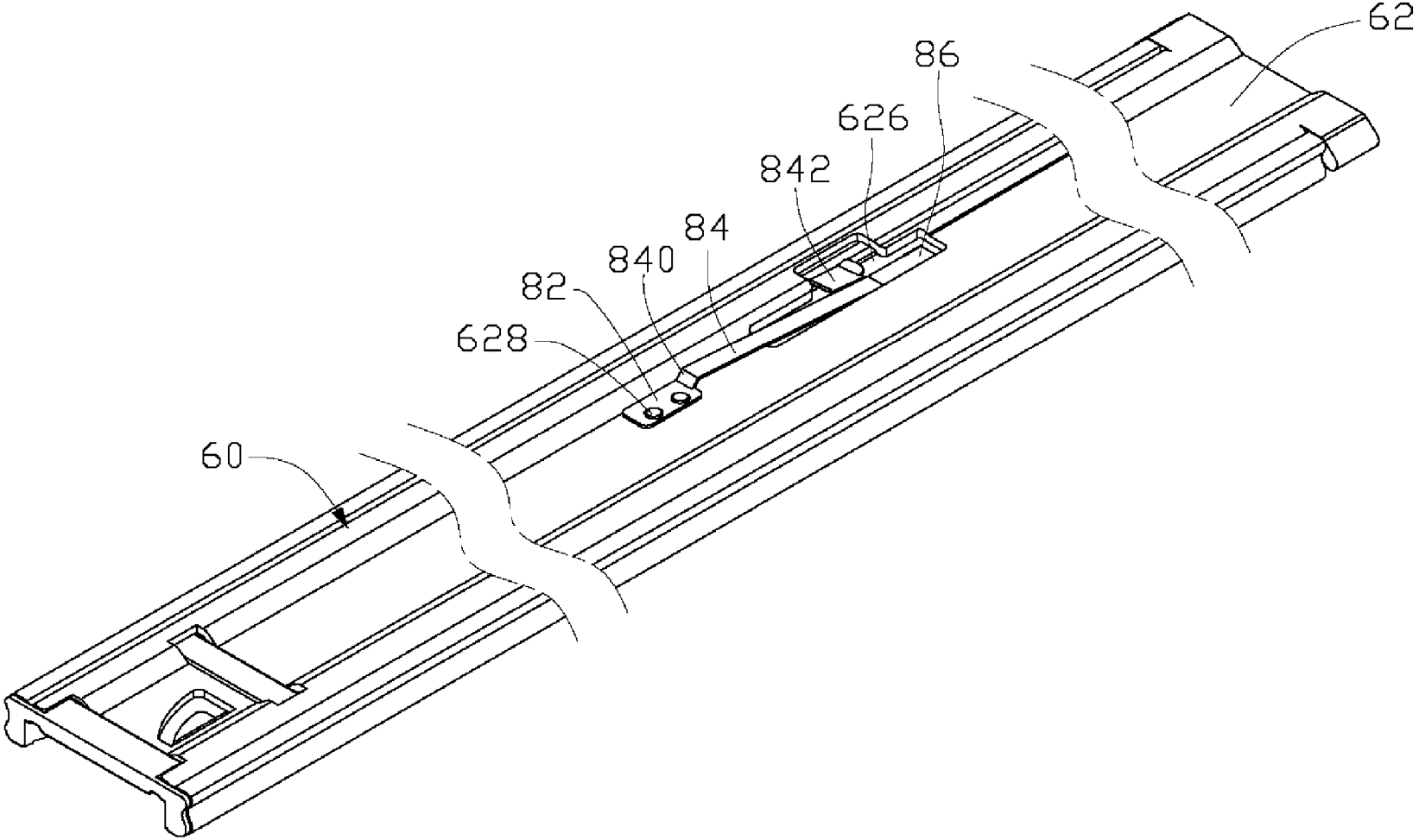
FIG. 3 is an assembled view of the positioning element and the intermediate slide of FIG. 1.

Referring also to FIG. 3, in assembly, the positioning element 80 is installed on a surface, facing the outer slide 70, of the intermediate slide 60 via rivets or screws 628 extending through the corresponding fixing holes 820 of the positioning element 80 to engage with the intermediate portion 62 of the intermediate slide 60. The fixing portion 82 is attached to the intermediate portion 62. The bridge portion 84 passes through the slot 626 of the intermediate slide 60. The plate 842, the hook portion 86, and the ears 860 are located at the surface, facing the inner slide 40, of the intermediate portion 62.

Figure 4:
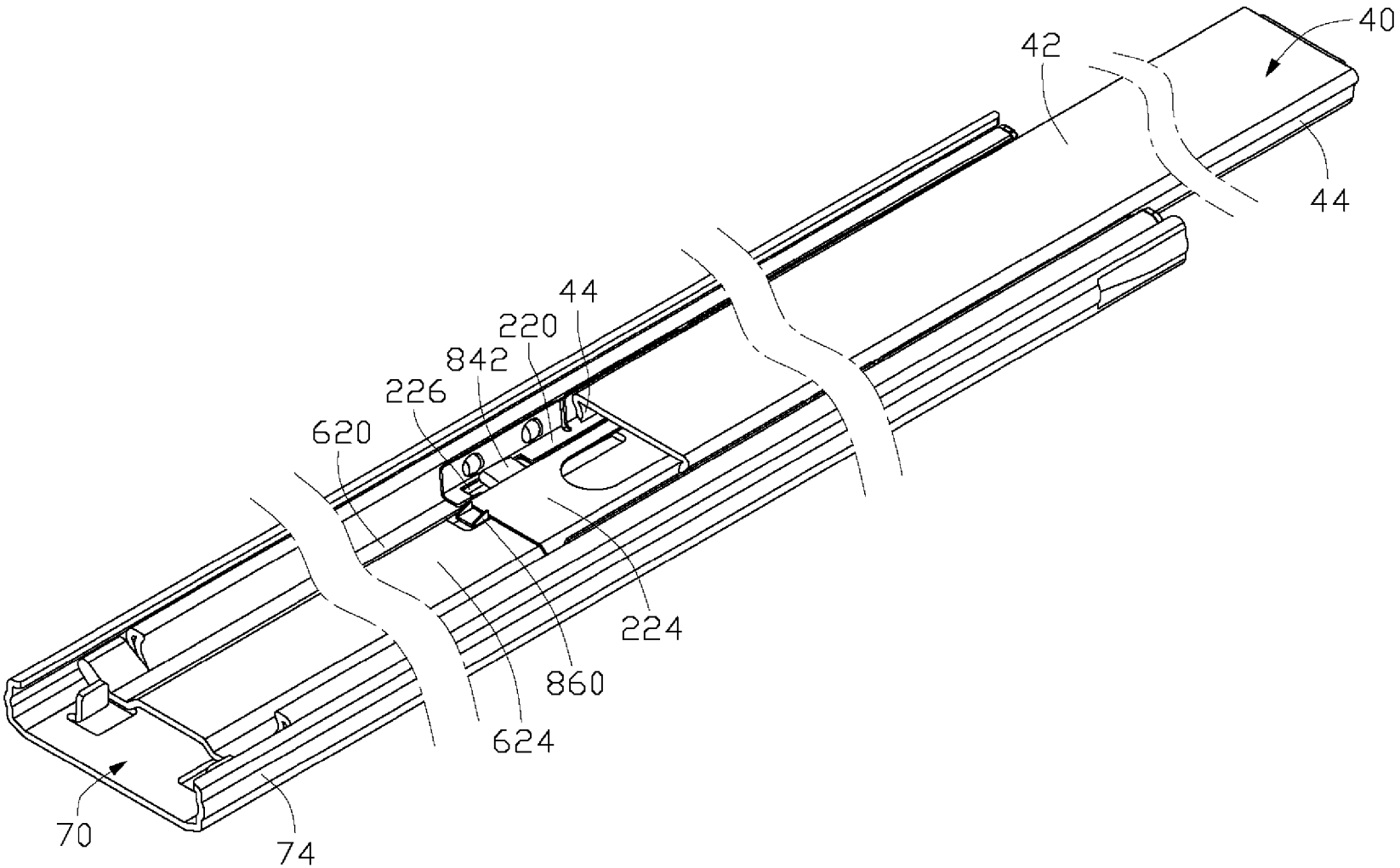
FIGS. 4 and 5 are assembled views of FIG. 1, but showing two using states of the slide rail.

Referring also to FIG. 4, the rack 20 is inserted into the intermediate slide 60. The first guiding grooves 220, 222 contact the second guiding grooves 620 of the intermediate slide 60. The ball bearings 240 fixed in the flanges 24 contact the second slideway grooves 640 of the intermediate slide 60, enabling smooth movement of the rack 20 relative to the intermediate slide 20. The first flat part 224 of the rack 20 presses the sloped surfaces 862 of the ears 860 of the positioning element 80 and moves toward the block 66 of the intermediate slide 60, until the end, opposite to the hole 226, of the rack 20 touches the block 66, and the end adjacent the hole 226 of the rack 20 rides over the ears 860 of the positioning element 80. The ears 860 are restored, with the upright surface 864 thereof engaging with the corresponding end of the rack 20, and the plate 842 passing through the hole 226 to enter into the rack 20. Therefore, the rack 20 is fixed in the intermediate slide 60 due to the two ends thereof being respectively restricted by the block 66 of the intermediate slide 60 and the upright surface 864 of the ears 860 of the positioning element 80.

Figure 5:
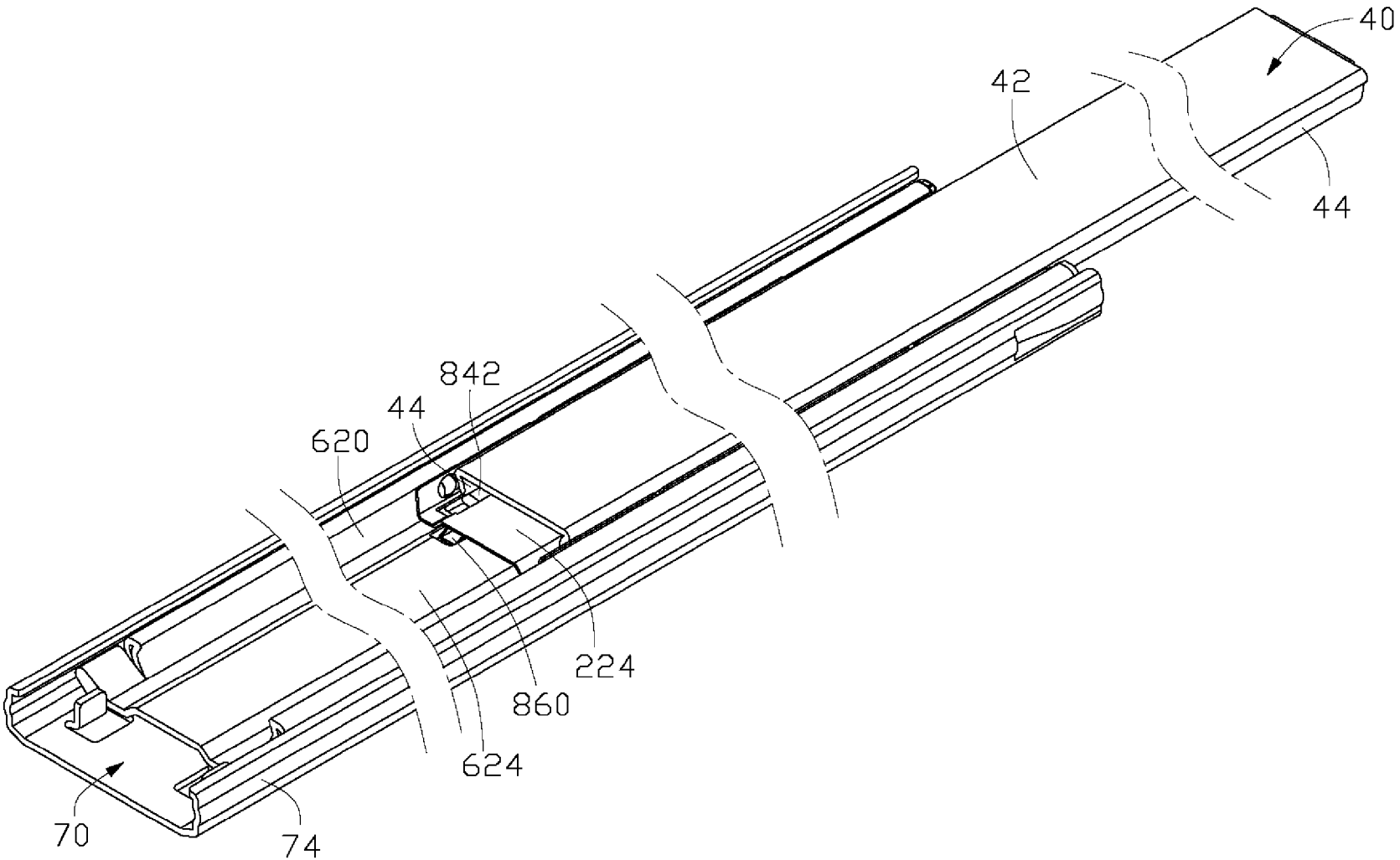

Referring also to FIG. 5, the inner slide 40 is inserted into the intermediate slide 60 through the end having the block 66, of the intermediate slide 60. The sidewalls 44 of the inner slide 40 contact the arms 660 of the block 66, for guiding the inner slide 40 to be inserted into the intermediate slide 60. Because the inner slide 40 is supported on the base of the block 66, the inner slide 40 will not collide with first flat part 224 of the rack 20, but keeps a slight distance from the rack 20. The first slideways of the sidewalls 44 accommodate the ball bearings 240 of the rack 20, for providing a smooth movement of the inner slide 40. The inner slide 40 is inserted to a position where the corresponding end thereof contacts the guiding plate 844. The inner slide 40 is further moved, until the plate 842 is pressed by the corresponding sidewall 44, due to the guiding plate 844 of the positioning element 80. The plate 842 together with the hook portion 86 is resiliently pressed to retract through the slot 626 of the intermediate slide 60, the ears 860 of the positioning element 80 are disengaged from the first flat part 224 of the rack 20. Thus, the rack 20 is unlocked. The inner slide 40 moves on, the corresponding first guiding groove 220 of the rack 20 instead of the corresponding sidewall 44 of the inner slide 40 resiliently presses the plate 842 of the positioning element 80.

The rack 20 is capable of being restricted between the block 66 and the positioning element 80. After the rack 20 is restricted, the inner slide 40 can be easily inserted into the intermediate slide 60 because of the ball bearings 240. Moreover, the inner slide 40 cannot collide with the rack 20 because the inner slide 40 is kept a slight distance from the rack 20 via being supported by the block 66.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A slide rail comprising:

an inner slide;

an intermediate slide for receiving the inner slide, a block being positioned at an end of the intermediate slide;

a rack having a plurality of ball bearings and disposed between the inner slide and the intermediate slide, the rack enabling smooth movement between the inner slide and the intermediate slide, the rack further having a first end and a second end, the first end of the rack being resisted against the block; and a positioning element comprising a fixing portion mounted to the intermediate slide, and a resilient hook portion having an ear part, the ear part comprising an upright surface capable of resisting against the second end of the rack to locate the rack;

wherein a plate is connected to one side of the positioning element adjacent and parallel to the hook portion, the plate being able to be pressed by the inner slide, therefore deforming the positioning element along a first direction perpendicular to the intermediate slide to release the rack from being resisted by the hook portion.

2. The slide rail as described in claim 1, wherein the intermediate slide comprises an intermediate portion and two sidewalls extending from opposite sides of the intermediate portion respectively, the inner slide and the rack being received in a space bounded by the intermediate portion and the sidewalls, a slot is defined in the intermediate portion, for allowing the positioning element to extend therethrough.

3. The slide rail as described in claim 2, wherein the positioning element further comprises a bridge portion at a middle position thereof to be extended through the slot of the intermediate slide, the fixing portion is connected to an end of the bridge portion to be fixed to a surface of the intermediate portion, and the hook portion is connected to the other end of the bridge portion to be positioned over another surface of the intermediate portion.

4. The slide rail as described in claim 3, wherein the bridge portion is made of elastic material.

5. The slide rail as described in claim 4, wherein the ear part comprises a sloped surface, the sloped surface being pressed by the rack as the rack moves towards the block.

6. The slide rail as described in claim 5, wherein the sloped surface is released from the rack when the second end of the rack contacts the block.

7. The slide rail as described in claim 1, wherein a hole is defined in the rack, for allowing the plate to extend therethrough.

8. The slide rail as described in claim 2, wherein the rack comprises a main part and two flanges extending from opposite sides of the main part, the ball bearings are rotatably mounted to each of the flanges, the ball bearings contact the sidewalls of the intermediate slide when the rack is inserted into the intermediate slide.

9. The slide rail as described in claim 8, wherein the main part of the rack comprises a flat part and at least a first guiding groove at opposite sides of the flat part and connecting to the flat part, the intermediate portion of the intermediate slide comprises at least a second guiding groove relative to the first guiding groove of the rack, for guiding the rack to be inserted into the intermediate slide along a longitudinal direction.

10. The slide rail as described in claim 1, wherein the ear part comprises a sloped surface and an upright surface at opposite ends, the rack presses the sloped surfaces of the ear part of the positioning element to deform the positioning element along a second direction inverse to the first direction and moves toward the block of the intermediate slide until the first end of the rack touches the block, and wherein the second end of the rack rides over the ear part of the positioning element, the ear part is restored with the upright surface thereof engaging with the second end of the rack, and the rack is fixed in the intermediate slide due to the two ends thereof being respectively restricted by the block of the intermediate slide and the upright surface of the ear part of the positioning element.

11. The slide rail as described in claim 10, wherein when the inner slide is inserted to a position where the corresponding end thereof contacts the plate of the positioning element, the inner slide is further moved until the plate is pressed by the inner slide, the plate together with the hook portion is resiliently pressed to deform the positioning element along the first direction perpendicular to the intermediate portion of the intermediate slide and retract through the slot of the intermediate slide, and the ear part of the positioning element is disengaged from the rack to unlock the rack.

12. A slide rail comprising:

an inner slide;

an intermediate slide for receiving the inner slide therein, the intermediate slide comprising an intermediate portion, two sidewalls extending from opposite sides of the intermediate portion, and a block being positioned at an end of the intermediate portion of the intermediate slide;

a rack having a first end, a second end, and a plurality of ball bearings and being disposed between the inner slide and the intermediate slide, the rack enabling smooth movement between the inner slide and the intermediate slide, the first end of the rack being resisted against the block; and a positioning element comprising a fixing portion mounted to the intermediate slide, a resilient hook portion having at least one ear part, and a plate connected to one side of the positioning element adjacent and parallel to the hook portion, the at least one ear part comprising a slope surface and an upright surface at an opposite side of the at least one ear part;

wherein when the rack presses the sloped surface of the at least one ear part of the positioning element to deform the positioning element along a first direction perpendicular to the intermediate portion of the intermediate slide and moves toward the block of the intermediate slide, until the first end of the rack touches the block, and a second end opposite to the first end of the rack rides over the ear part of the positioning element, the at least one ear part is restored, with the upright surface thereof engaging with the second end of the rack; and wherein when the inner slide is inserted to a position where a corresponding end thereof contacts the plate of the positioning element, the inner slide is further moved until the plate is pressed by the inner slide, the plate together with the hook portion is pressed to resiliently deform the positioning element along the first direction, and the at least one ear part of the positioning element is disengaged from the rack.

13. The slide rail as described in claim 12, wherein the inner slide and the rack are received in a space bounded by the intermediate portion and the sidewalls, and a slot is defined in the intermediate portion for allowing the positioning element to extend therethrough.

14. The slide rail as described in claim 13, wherein the positioning element further comprises a bridge portion at a middle position thereof to be extended through the slot of the intermediate slide, the fixing portion is connected to an end of the bridge portion to be fixed to a surface of the intermediate portion, and the hook portion is connected to the other end of the bridge portion to be positioned over another surface of the intermediate portion.

15. The slide rail as described in claim 14, wherein the bridge portion is not parallel to the fixing portion.

16. The slide rail as described in claim 14, wherein a vertical distance between the fixing portion and a first end of the bridge portion is slightly greater than that between the fixing portion and a second end of the bridge portion.

17. The slide rail as described in claim 14, wherein the hook portion is slanting toward the bridge portion but is parallel to the fixing portion.

18. The slide rail as described in claim 12, wherein the plate is slightly raised from the bridge portion and has two guiding parts slantingly extending from opposite ends thereof respectively.

* * * * *